US010210779B2

(12) United States Patent
Enriquez

(10) Patent No.: US 10,210,779 B2
(45) Date of Patent: Feb. 19, 2019

(54) POLYHEDRAL AUTOMATIC POP-UP DISPLAY

(71) Applicant: R.R. Donnelley & Sons Company, Chicago, IL (US)

(72) Inventor: Carlos Enriquez, Pleasant Prairie, WI (US)

(73) Assignee: R.R. DONNELLEY & SONS COMPANY, Chicago, IL (US)

( * ) Notice: Subject to any disclaimer, the term of this patent is extended or adjusted under 35 U.S.C. 154(b) by 0 days.

(21) Appl. No.: 15/909,155

(22) Filed: Mar. 1, 2018

(65) Prior Publication Data

US 2018/0268748 A1 Sep. 20, 2018

Related U.S. Application Data

(60) Provisional application No. 62/472,250, filed on Mar. 16, 2017.

(51) Int. Cl.
*G09F 15/00* (2006.01)
*A47F 5/11* (2006.01)
(Continued)

(52) U.S. Cl.
CPC ..... *G09F 15/0062* (2013.01); *A47F 5/11* (2013.01); *G09F 1/04* (2013.01); *G09F 1/10* (2013.01);
(Continued)

(58) Field of Classification Search
CPC ..... G09F 15/0062; G09F 15/0025; A47F 5/11
See application file for complete search history.

(56) References Cited

U.S. PATENT DOCUMENTS 822,841 A 6/1906 Hill
956,916 A 5/1910 Wiederseim, Jr.
(Continued)

FOREIGN PATENT DOCUMENTS

CN 203192354 9/2013
DE 2658506 1/1978
(Continued)

OTHER PUBLICATIONS

International Searching Authority, "International Search Report and Written Opinion", issued in connection with PCT Application No. PCT/US2016/064478, dated Jan. 24, 2017, 15 pages.
(Continued)

*Primary Examiner* — Gary C Hoge
(74) *Attorney, Agent, or Firm* — Hanley Flight & Zimmerman, LLC

(57) ABSTRACT

A display apparatus includes a first substrate and a second substrate disposed in opposition to one another and connected to one another to form a shroud, the first substrate and the second substrate being connected to form a first joint at a first lateral end of the shroud, a second joint at a second lateral end of the shroud and a third joint formed at a lower portion of the shroud, the third joint including a first base connection member rotatably depending from a lower portion of the first substrate and a second base connection member rotatably depending from a lower portion of the second substrate, the third joint being located at a first position in the shroud with the shroud in a compressed state and being located in a second position in the shroud with the shroud in an uncompressed state. The display apparatus also includes a resilient member connecting the first joint to the third joint and connecting the second joint to the third joint to bias the third joint from the first position to the second position when the shroud is the uncompressed state.

20 Claims, 12 Drawing Sheets

(51) Int. Cl.
*G09F 1/10* (2006.01)
*G09F 1/04* (2006.01)
*G09F 7/18* (2006.01)

(52) U.S. Cl.
CPC .. *G09F 15/0025* (2013.01); *G09F 2007/1856* (2013.01)

(56) References Cited

U.S. PATENT DOCUMENTS 1,028,147 A 6/1912 Stranders
1,545,771 A 7/1925 Hout
1,576,672 A 3/1926 Miller
1,656,341 A 1/1928 Smith
1,670,464 A 5/1928 Marsh
1,687,616 A 10/1928 Huye
1,902,566 A 3/1933 Marsh
2,108,349 A 2/1938 Rasmussen
2,113,288 A 4/1938 Berger
2,142,826 A 1/1939 Rosello
2,153,460 A 4/1939 Giles
2,210,317 A 8/1940 Dueringer
2,283,406 A 5/1942 Bacon
2,290,144 A 7/1942 Katz
2,404,089 A 7/1946 Pollock
2,601,374 A 6/1952 Ditzler et al.
2,637,924 A 5/1953 Hutt
2,728,461 A 12/1955 Paige
2,773,324 A 12/1956 Drueck, Jr.
2,833,074 A 5/1958 Jannes
2,892,276 A 6/1959 Nelson
2,918,178 A 12/1959 Leone
2,984,920 A 5/1961 Acosta et al.
3,015,898 A 1/1962 Keeslar
3,091,877 A 6/1963 Luchsinger
3,234,682 A 2/1966 Frankl
3,267,597 A 8/1966 Jannes
3,302,321 A 2/1967 Walker
3,571,958 A 3/1971 Stevens et al.
3,665,669 A 5/1972 Huber
3,666,607 A 5/1972 Weissman
4,234,148 A 11/1980 Maddestra et al.
4,610,363 A 9/1986 Flum et al.
4,619,426 A 10/1986 Drueck, Jr.
4,750,283 A 6/1988 Halpern
4,770,379 A 9/1988 Estvold
4,773,622 A 9/1988 Herlin
4,774,780 A 10/1988 Crowell
4,790,714 A 12/1988 Schnapp
4,854,060 A 8/1989 Corbo et al.
4,940,199 A 7/1990 Hall
4,984,848 A 1/1991 Scalisi et al.
4,993,846 A 2/1991 Diamond et al.
5,000,717 A 3/1991 Pfeiffer
5,193,466 A 3/1993 Eder
5,197,631 A 3/1993 Mishima
5,297,677 A 3/1994 Burian et al.
5,416,997 A 5/1995 Dyment et al.
5,454,180 A 10/1995 Volpe
5,467,547 A 11/1995 Fortner
5,632,390 A 5/1997 Podergois
5,752,649 A 5/1998 Weder
5,758,438 A 6/1998 Crowell
5,778,959 A 7/1998 Guetschow
5,787,621 A 8/1998 Leksell
5,809,673 A 9/1998 Johnson et al.
5,868,367 A 2/1999 Smith
5,878,945 A 3/1999 Weder
5,937,553 A 8/1999 Maran
5,966,857 A 10/1999 Pettersson et al.
5,983,538 A 11/1999 Crowell
6,311,418 B1 11/2001 Crowell
6,347,772 B1 2/2002 L'Hotel
6,497,601 B1 12/2002 Ward
7,134,230 B1 11/2006 Boens et al.
7,159,350 B2 1/2007 L'Hotel
7,234,253 B2 6/2007 Ossmann
7,437,842 B2 10/2008 Sgambellone
7,634,865 B2 12/2009 L'Hotel
7,726,054 B2 6/2010 Mestres Armengol et al.
7,774,964 B2 8/2010 L'Hotel
7,980,013 B2 7/2011 Hsu
8,099,883 B2 1/2012 Mestres Armengol et al.
8,112,925 B2 * 2/2012 Tzuo ..... G09F 1/065 248/147
8,291,631 B2 10/2012 Wilder
8,458,939 B2 6/2013 Arthur et al.
8,590,188 B2 11/2013 Mirsch
8,701,321 B2 4/2014 Da Fonseca et al.
8,776,415 B2 7/2014 Kawaguchi et al.
8,826,833 B1 9/2014 Fischer et al.
8,863,418 B2 10/2014 Acker et al.
8,875,908 B2 11/2014 L'Hotel
9,173,485 B2 11/2015 Fischer et al.
9,715,840 B1 * 7/2017 Warmus ..... G09F 1/065
9,978,292 B2 5/2018 Santoro
2004/0111930 A1 6/2004 Ossmann
2008/0066353 A1 3/2008 Mills
2008/0083146 A1 8/2008 Martin Presa
2010/0043261 A1 * 2/2010 Arthur ..... G09F 1/06 40/1
2010/0072330 A1 * 3/2010 Tzuo ..... A47B 43/02 248/174
2010/0236117 A1 9/2010 Mestres Armengol et al.
2011/0088300 A1 4/2011 Presa
2011/0179685 A1 7/2011 Mirsch
2012/0012734 A1 1/2012 Tzuo
2012/0227297 A1 * 9/2012 Kawaguchi ..... G09F 1/06 40/610
2013/0219760 A1 8/2013 Acker et al.
2014/0265777 A1 9/2014 Fischer et al.
2016/0335925 A1 11/2016 Ruhaak
2016/0335934 A1 11/2016 Lyon
2016/0335935 A1 11/2016 Lyon
2017/0193866 A1 7/2017 Bonifas
2017/0213485 A1 * 7/2017 Santoro, Jr. ..... G09F 1/065
2017/0249874 A1 * 8/2017 Lopez Fern Ndez ... G09F 1/065
2017/0294149 A1 10/2017 Lyon
2018/0040262 A1 2/2018 Lyon
2018/0075781 A1 3/2018 Cwidak et al.
2018/0075788 A1 3/2018 Warmus et al.

FOREIGN PATENT DOCUMENTS

DE 4005925 10/1991
DE 4314654 11/1994
DE 9320993 8/1995
DE 202010015312 1/2011
DE 202011002980 4/2011
DE 202014106297 3/2015
DK 9500055 5/1995
DK 9500277 9/1995
EP 1741368 1/2007
EP 1830334 9/2007
EP 1926076 5/2008
EP 2290637 3/2011
EP 2400477 12/2011
ES 2212927 8/2004
ES 2255857 7/2006
FR 1254983 3/1961
FR 2210317 7/1974
FR 2232259 12/1974
FR 2233912 1/1975
FR 2571949 4/1986
FR 2574968 6/1986
FR 2650907 2/1991
FR 2680030 2/1993
FR 2691621 12/1993
FR 2730148 8/1996
FR 2735264 12/1996
FR 2745109 8/1997
FR 2760801 9/1998
FR 2760802 9/1998
FR 2760880 9/1998

(56) References Cited

FOREIGN PATENT DOCUMENTS

| | | |
|---|---|---|
| FR | 2770320 | 4/1999 |
| FR | 2911425 | 7/2008 |
| FR | 2925203 | 6/2009 |
| FR | 2925204 | 6/2009 |
| FR | 2948222 | 1/2011 |
| GB | 463574 | 4/1937 |
| GB | 740577 | 11/1955 |
| GB | 743378 | 1/1956 |
| GB | 824004 | 11/1959 |
| GB | 1034280 | 6/1966 |
| GB | 1272187 | 1/1972 |
| GB | 1317155 | 5/1973 |
| WO | 9634379 | 10/1996 |
| WO | 9936900 | 7/1999 |
| WO | 2002095719 | 11/2002 |
| WO | 2004044867 | 5/2004 |
| WO | 2006040438 | 4/2006 |
| WO | 2006067252 | 6/2006 |
| WO | 2007138083 | 12/2007 |
| WO | 2008049176 | 5/2008 |
| WO | 2010019086 | 2/2010 |
| WO | 2010130485 | 11/2010 |
| WO | 2011092209 | 8/2011 |
| WO | 2011113123 | 9/2011 |
| WO | 2012061375 | 5/2012 |
| WO | 2016057067 | 4/2016 |
| WO | 2017116605 | 7/2017 |

OTHER PUBLICATIONS

International Searching Authority, "International Search Report," issued in connection with PCT Patent Application No. PCT/US2017/045471, dated Oct. 18, 2017, 5 pages.

International Searching Authority, "Written Opinion," issued in connection with PCT Patent Application No. PCT/US2017/045471, dated Oct. 18, 2017, 6 pages.

* cited by examiner

POLYHEDRAL AUTOMATIC POP-UP DISPLAY

RELATED APPLICATION

This patent arises from a non-provisional application based on U.S. Provisional Application Ser. No. 62/472,250 filed on Mar. 16, 2017, which is hereby incorporated by reference in its entirety.

FIELD OF THE DISCLOSURE

This disclosure relates generally to displays, methods of making displays, and mechanisms for maintaining such displays in an erect state.

BACKGROUND

Displays may be used at a point of purchase to provide advertising or other information. Some of these displays have a tubular shape and include outwardly facing indicia.

BRIEF DESCRIPTION OF THE DRAWINGS

The figures are not to scale. Wherever possible, the same reference numbers will be used throughout the drawings and accompanying written description to refer to the same or like parts.

DETAILED DESCRIPTION

The examples disclosed herein relate to displays that can be used for point-of-sale advertising, providing information or for other suitable purposes. The example displays disclosed herein are configured to be collapsed to a folded, flat state, which facilitates shipping and transport, and are configured to be readily erected at a location (e.g., a point-of-sale, a conference booth, a store, etc.) to effect a desired display function.

In some examples disclosed herein, the example displays include one or more substrates (e.g., a sheet material, a panel, etc.) that, singly or in combination, form a shroud into which one or more internal support members are disposed or are able to be disposed. In some examples, the deployed shroud is a polyhedral shape having a polygonal cross-section.

A base structure is optionally attached to or integrated with one or more portions of the shroud, such as a base portion, to help to maintain the shroud in a desired orientation.

As is disclosed herein, the polyhedral display is formed by (1) assembling one or more substrates together or by (2) deploying an assembled polyhedral display from a compressed or folded state.

Figure 1:
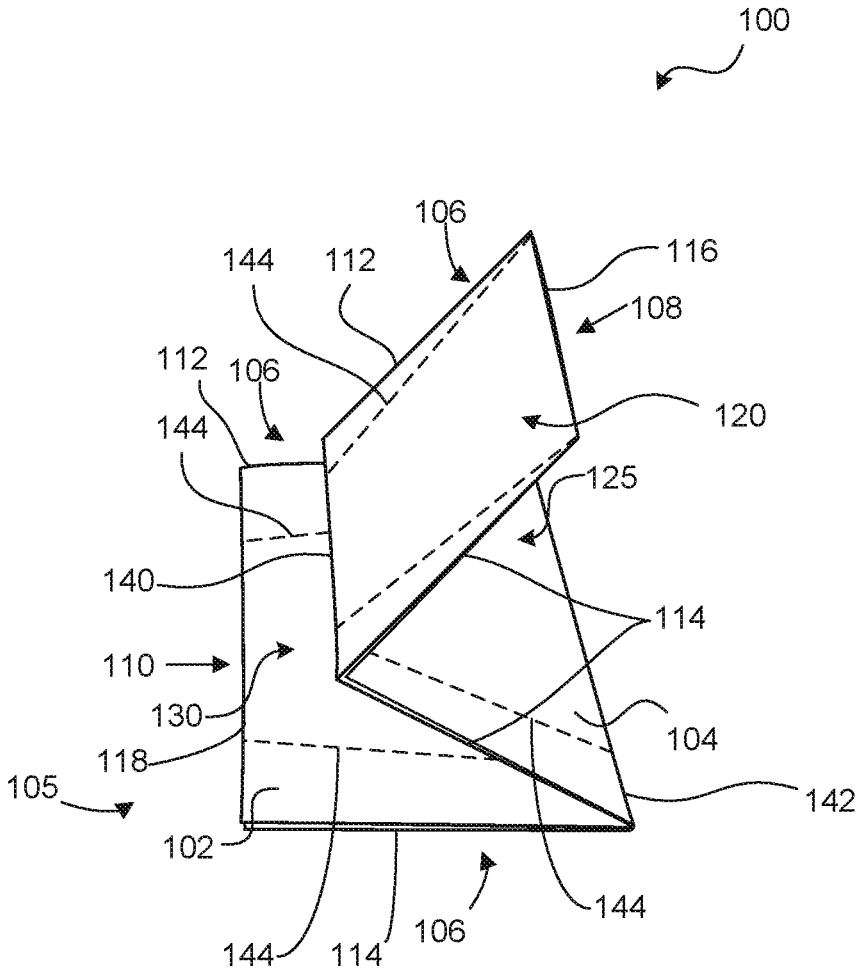
FIG. 1 is a perspective view of an example polyhedral display in accordance with teachings herein, showing the example display transitioning from a folded state to an erected or deployed state in accordance with teachings herein.

FIG. 1 shows an example of erecting the polyhedral display 100, from a substantially flat initial state (not shown), to the depicted partially unfolded state (FIG. 1). In the example depicted in FIG. 1, the polyhedral display 100 is formed by joining together a first substrate 102 and a second substrate 104 to define a shroud 105.

The first substrate 102 and the second substrate 104 each include connection members at lateral sides thereof to permit connection of the first substrate 102 to the second substrate 104. In one example, the first substrate 102 and the second substrate 104 each includes one or more connection members at lateral sides 106, at an upper portion 108, and at a lower portion 110. The first substrate 102 and the second substrate 104 are jointed together via the connection members to form a first lateral joint 112, a second lateral joint 114, and an upper joint 116. In some examples, one or more of the connection members include flaps. In some examples, the upper joint 116 connection members include hook-and-loop fasteners (e.g., VELCRO®, etc.) or an adhesive.

The first substrate 102 and the second substrate 104 may comprise n segments, where n is any number including, but not limited to, one segment, two segments, three segments (as shown), four segments, or more than four segments. In the example shown, the first substrate 102 includes three segments 120, 125, and 130 and the second substrate 104 includes three segments 120, 125, and 130. In some examples, each segment 120, 125, 130 of the first substrate 102 and the second substrate 104 includes connection members at lateral sides 106 thereof. Where the first substrate 102 and the second substrate 104 comprise a plurality of segments, each segment (e.g., segments 120, 125, and 130) is hinged to an adjacent segment by a line of weakness 140, 142. For instance, segment 120 of the first substrate 102 is hinged to segment 125 of the first substrate 102 by a line of weakness 140 formed in the first substrate 102. Likewise, segment 120 of the second substrate 104 is hinged to segment 125 of the second substrate 104 by a line of weakness 140 formed in the second substrate 104. The lines of weakness 140, 142 are formed in substantially the same height along a height of each of the first substrate 102 and the second substrate 104. In this configuration, the lines of weakness 140, 142 of the first substrate 102 are substantially vertically aligned with the lines of weakness 140, 142 of the second substrate 104 to permit the segments 120, 125, 130 to fold as a unit, with the segments 120 folding over segments 125 about lines of weakness 140 and the segments 125 folding over segments 130 about lines of weakness 142. The example polyhedral display 100 can thus be collapsed and folded for transport or shipping and/or storage by flattening each segment 120, 125, 130 and rotating each segment 120, 125, 130 about the respective lines of weakness 140, 142. These lines of weakness 140, 142 enable the example polyhedral display 100 to be folded relatively flat, with adjacent segments 120, 125, 130 being folded against one-another along the lines of weakness 140, 142, such as in a multi-part z-fold.

Figure 2:
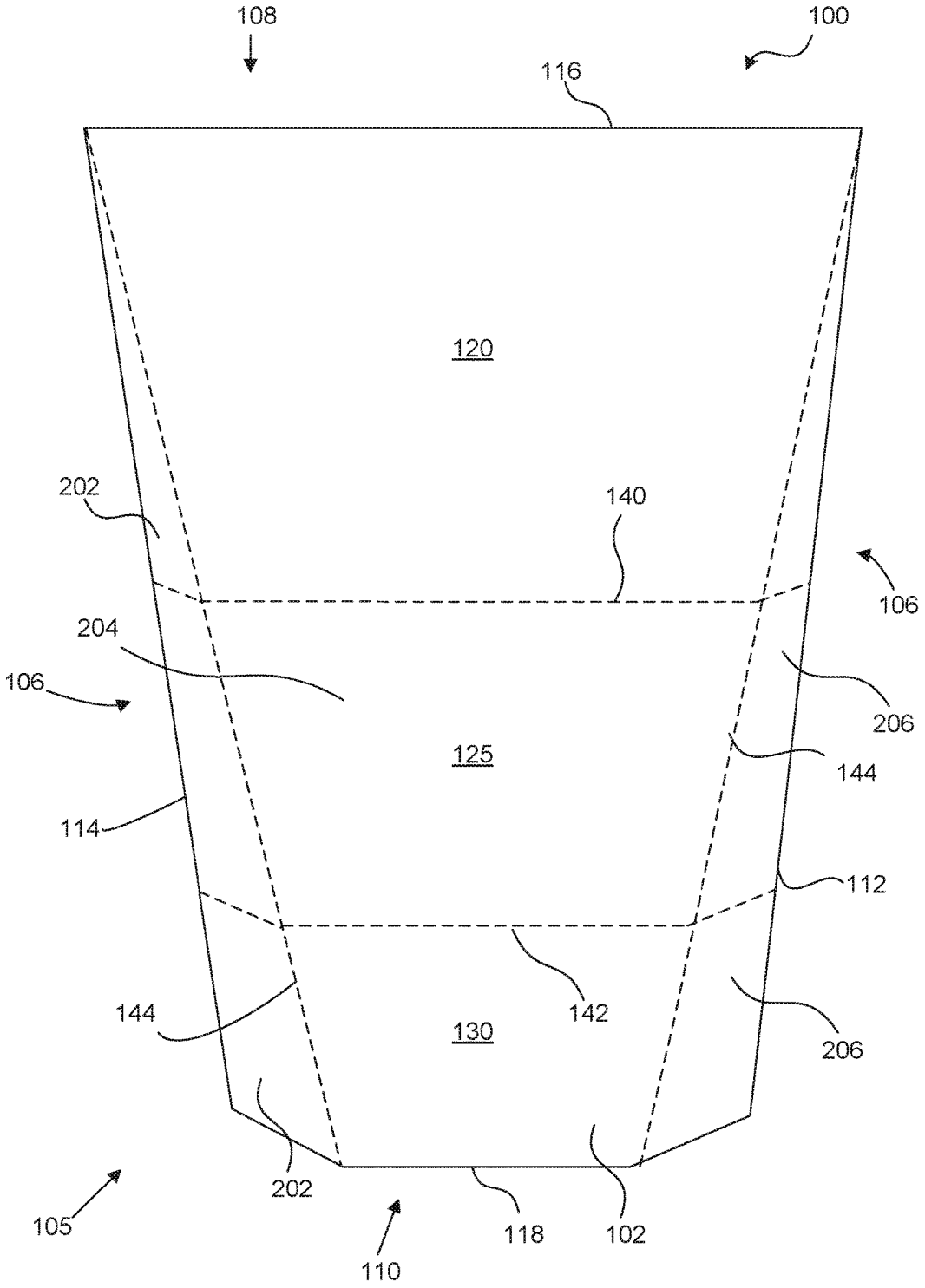
FIG. 2 is a front perspective view of the example polyhedral display of FIG. 1 in accordance with teachings herein.

FIG. 1 also shows lines of weakness 144 extending inwardly from lateral corners at the upper joint 116 of the first substrate 102 and the second substrate 104 to a middle portion (e.g., between the first lateral joint 112 and the second lateral joint 114) and bottom portion 118 (e.g., a bottom edge, etc.) of the respective one of the first substrate 102 and the second substrate 104. The first substrate 102 and the second substrate 104 are hinged about these lines of weakness 144 and present, in a deployed state as shown in FIG. 2, a polyhedral display 100. While the example lines of weakness 144 are shown to extend inwardly from lateral corners at the upper joint 116 of the first substrate 102 and the second substrate 104 to the bottom portion 118 of the respective one of the first substrate 102 and the second substrate 104, the lines of weakness 144 may extend across only one segment or more than one segment in some examples. Further, the angles of the lines of weakness 144 and positioning of the lines of weakness 144 may be varied, as compared to the depicted example of FIGS. 1-2, to form a polyhedral display 100 defining different polygonal faces or facets. Additionally, in some examples, the lines of weakness 144 of the first substrate 102 may be different than the lines of weakness 144 of the second substrate 104 so as to create an asymmetric polyhedral display 100.

In some examples, the deployed state is achieved, for a folded, multi-segment polyhedral display 100, by unfolding the multi-segment example polyhedral display 100, which causes automatic deployment (see, e.g., FIGS. 1-2). In some examples, the deployed state is achieved by removing compression of the shroud 105, such as by removing a compressed shroud 105 from an enclosure (e.g., an envelope, a case, etc.) to permit the compressed shroud 105 to automatically transition to an uncompressed, or deployed, state.

FIG. 2 is a front perspective view of the example polyhedral display 100, showing example lines of weakness 144 extending inwardly from lateral corners at the upper joint 116 of the first substrate 102 to the bottom portion 118 of the first substrate 102 to define a first facet 202, a second facet 204 and a third facet 206. As described in FIG. 1, lines of weakness 140, 142 are provided to facilitate folding of the segments 120, 125, and 130 about one another for storage and/or transportation of the example polyhedral display 100.

Figure 3:
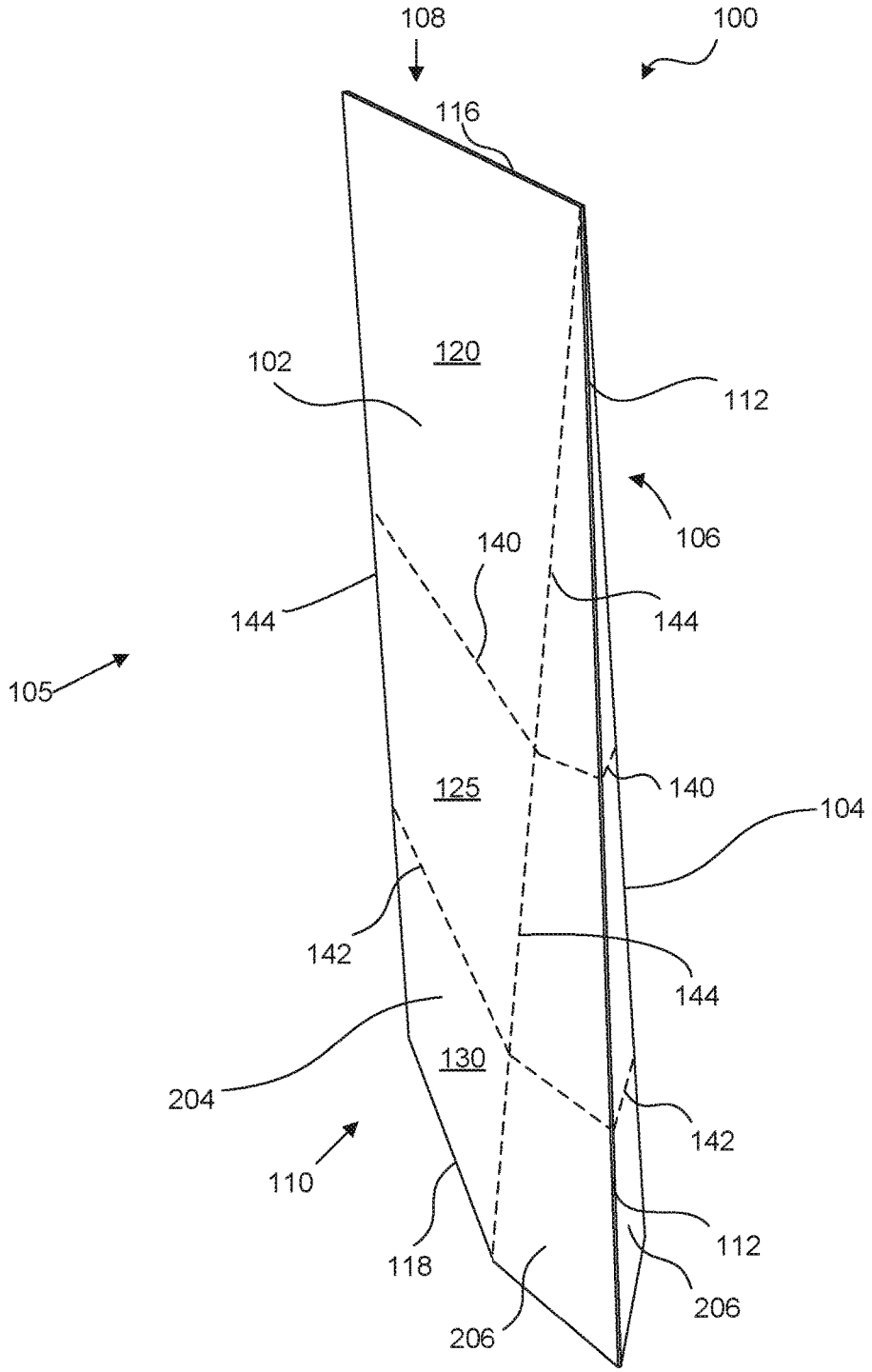
FIG. 3 is a perspective side view of the example polyhedral display of FIGS. 1-2 in accordance with teachings herein.

FIG. 3 is a perspective side view of the example polyhedral display of FIGS. 1-2. In this view, the first facet 202 is not seen, as the portion of substrate 102 that is angled toward the joint 114 about the line of weakness 144 is obscured. The first lateral joint 112 formed between the first substrate 102 and the second substrate 104 is shown in the foreground. FIG. 3 shows that the overall profile or shape of the example polyhedral display 100 of FIGS. 2-3 is a wedge shape, with the upper portion 108 having a narrower profile than the lower portion 110.

Figure 4:
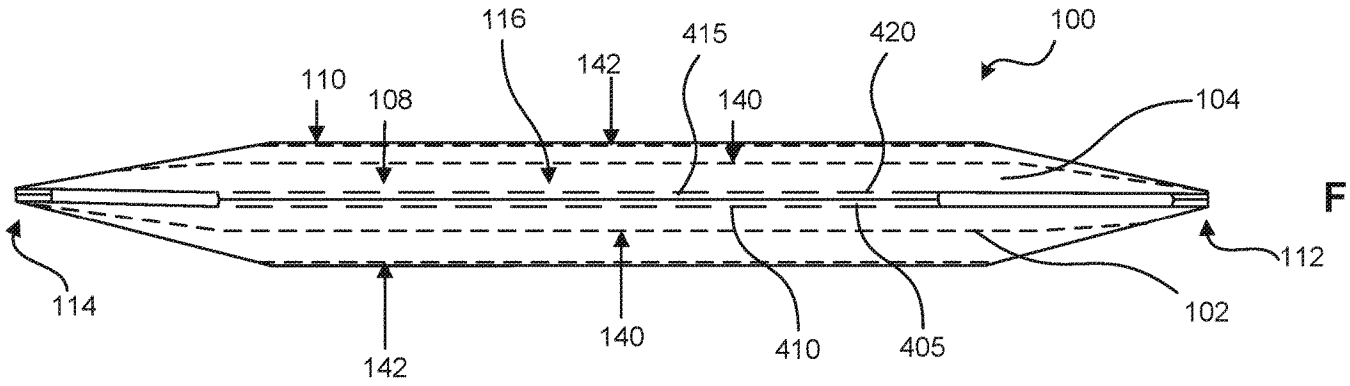
FIG. 4 is a top view of the example polyhedral display of FIGS. 2-3 in accordance with teachings herein.

FIG. 4 is a top view of the example polyhedral display 100 of FIGS. 2-3 showing the wedge-shaped profile of the example polyhedral display 100, with the upper portion 108 having a narrower profile than the lower portion 110. In the example of FIG. 4, at the upper joint 116 of the first substrate 102 and the second substrate 104, an example first upper connection member 405 is shown to be connected to the first substrate 102 by a hinge including a line of weakness 410. FIG. 4 also shows, at the upper joint 116, an example second upper connection member 415 connected to the second substrate 104 by a hinge including a line of weakness 420. The example first upper connection member 405 is connected to the example second upper connection member 415 via hook-and-eye fasteners, hook-and-loop fasteners (e.g., VELCRO® brand fasteners, etc.), resilient members (e.g., rubber bands, etc.) pins, snap fasteners, string, twist ties, bonding agents and/or adhesives. In some examples, the polyhedral display 100 may omit the upper joint 116.

Figure 5:
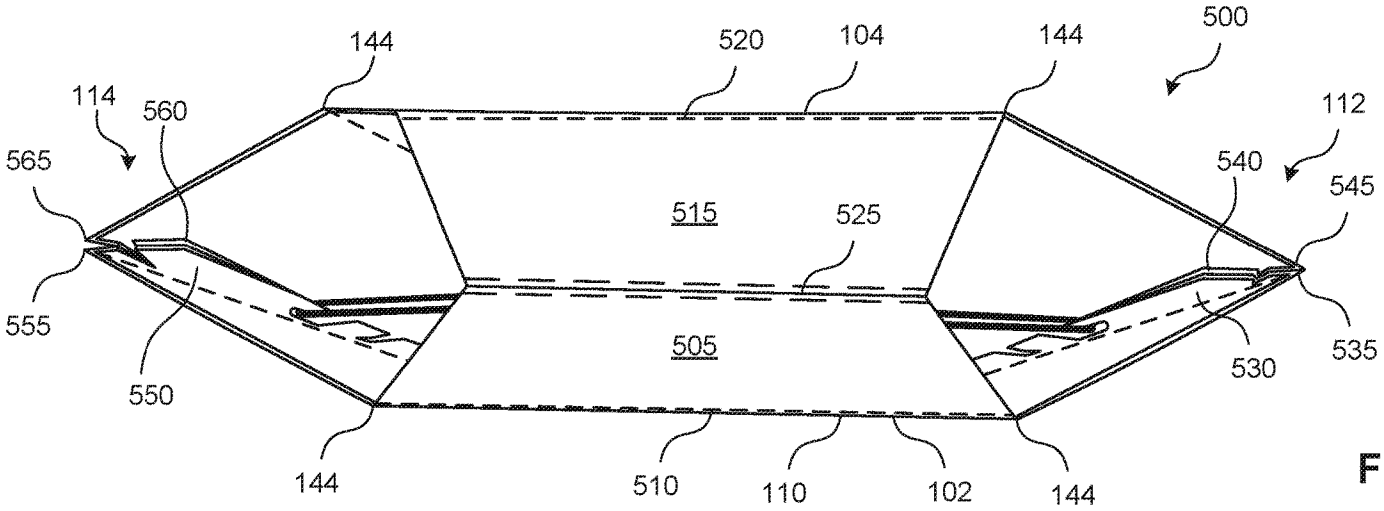
FIG. 5 is a bottom view of the example polyhedral display of FIGS. 2-4 in accordance with teachings herein.

FIG. 5 is a bottom view of the example polyhedral display 100 of FIGS. 2-4 showing the lower portion 110 of the example polyhedral display 100 and, in particular, an example base 500 of the example polyhedral display 100. In the example base 500, an example first base connection member 505 is connected to the first substrate 102 at a proximal end by a hinge including a line of weakness 510 formed in the first substrate 102 and an example second base connection member 515 is connected to the second substrate 104 at a proximal end by a hinge including a line of weakness 520 formed in the second substrate 104. The example first base connection member 505 is connected at a distal end to a distal end of the example second base connection member 515 to form an example base joint 525, which is described below in FIGS. 7-10.

In a stowed or compressed state, the example first base connection member 505 and the example second base connection member 515 are folded about the respective lines of weakness 510, 520 against the respective one of the first substrate 102 and the second substrate 104. In a deployed state or uncompressed state, as shown in the example of FIG. 5, the example first base connection member 505 and the example second base connection member 515 are rotated about the respective lines of weakness 510, 520 to a position that is acute (e.g., less than 90°) to the first substrate 102 and the second substrate 104. In this configuration, the base joint 525 formed between the example first base connection member 505 and the example second base connection member 515 is disposed within the shroud 105 at a height above the hinges defined by the lines of weakness 510, 520. Stated differently, the example first base connection a ember 505 and the example second base connection member 515 form an angle (e.g., an obtuse angle) therebetween at the base joint 525, rather than forming a straight line. Positioning the base joint 525 within the shroud 105 in this manner facilitates closure of the example polyhedral display 100.

In some examples, the example first base connection member 505 and the example second base connection member 515 are rotated about the respective lines of weakness 510, 520 to a position that is at least substantially perpendicular to the first substrate 102 and the second substrate 104 or, alternatively, substantially parallel to a support or surface on which the example polyhedral display 100 is disposed.

FIG. 5 shows the example first lateral joint 112 to include a first connection member 530 depending from the first substrate 102 by a hinge including a line of weakness 535 and to include a second connection member 540 depending from the second substrate 104 by a hinge including a line of weakness 545. The first connection member 530 and the second connection member 540 are rotated inwardly about the respective lines of weakness 535, 545 and are connected together. In some examples, the first connection member 530 and the second connection member 540 are connected by one or more of clips, hook-and-eye fasteners, hook-and-loop fasteners (e.g., VELCRO® brand fasteners, etc.), resilient members (e.g., rubber bands, etc.), pins, snap fasteners, string, twist ties, bonding agents and/or adhesives, in any combination of mechanical and/or chemical fasteners. In the illustrated example first lateral joint 112, the first connection member 530 and the second connection member 540 are connected by rubber bands.

FIG. 5 also shows the example second lateral joint 114 to include a first connection member 550 depending from the first substrate 102 by a hinge including a line of weakness 555 and to include a second connection member 560 depending from the second substrate 104 by a hinge including a line of weakness 565. The first connection member 550 and the second connection member 560 are rotated inwardly about the respective lines of weakness 555, 565 and are connected together. In some examples, the first connection member 550 and the second connection member 560 are connected by one or more of clips, hook-and-eye fasteners, hook-and-loop fasteners (e.g., VELCRO® brand fasteners, etc.), resilient members (e.g., rubber bands, etc.), pins, snap fasteners, string, twist ties, bonding agents and/or adhesives, in any combination of mechanical and/or chemical fasteners. In the illustrated example second lateral joint 114, the first connection member 550 and the second connection member 560 are connected by rubber bands.

Figure 6:
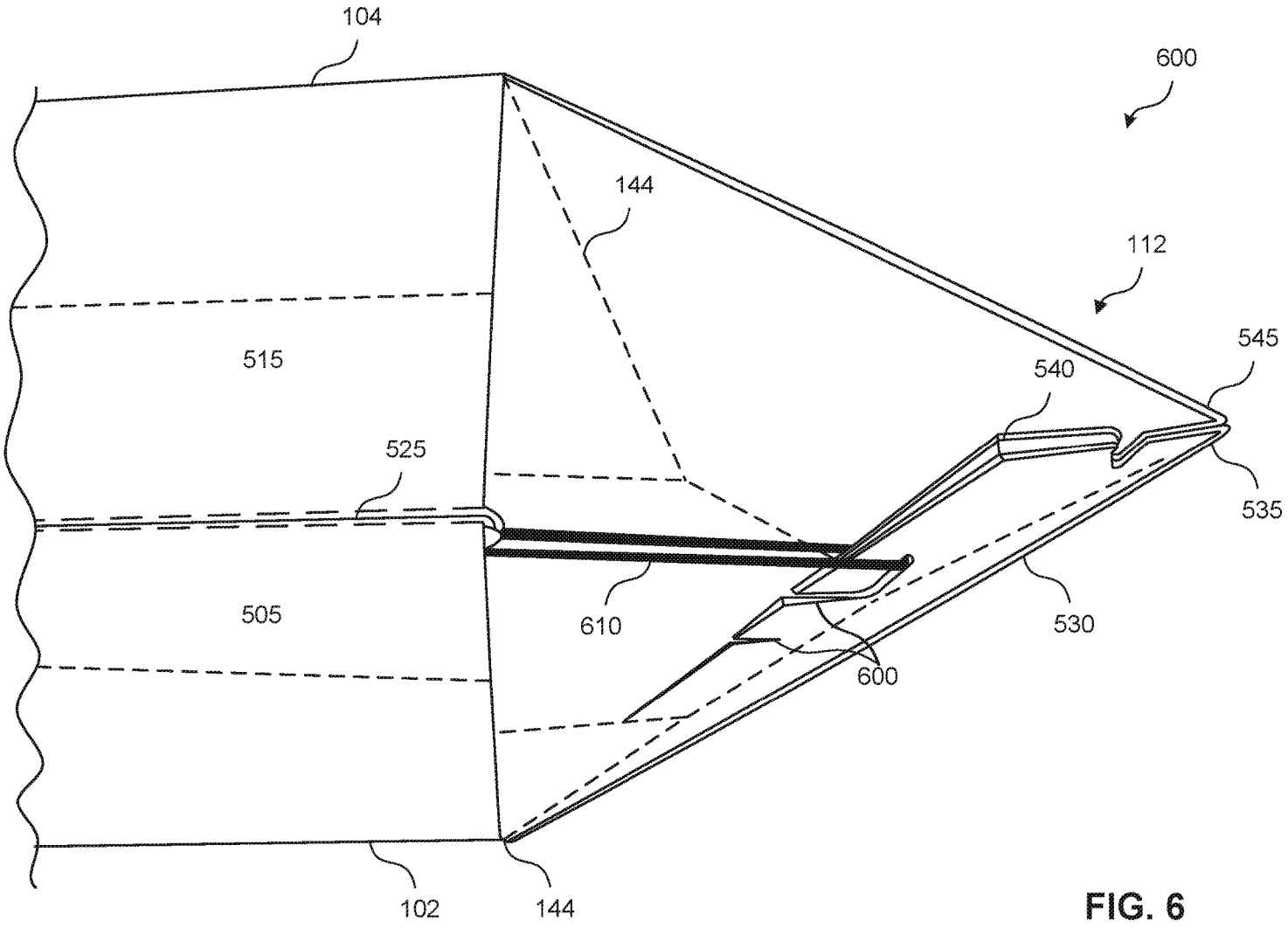
FIG. 6 is a bottom view of a portion of the example polyhedral display of FIG. 5 in accordance with teachings herein.

FIG. 6 is a bottom view of the example polyhedral display 100 of FIG. 5, highlighting a first lateral side of the example base 500 and the first lateral joint 112. A second lateral side of the example base 500, on the opposing side of the example polyhedral display 100 is substantially similar to the first lateral side of the example base 500. As shown more clearly in the example of FIG. 6, the first lateral joint 112 includes a plurality of connection features 600 such as, for example, notches 600 formed therein, which are described in relation to FIGS. 8-10. One of the plurality of notches 600 retains a first end of a first resilient member 610. In some examples, the first resilient member 610 is a rubber band. In the example of FIG. 6, a second end of the first resilient member 610 is connected to the base joint 525 formed by the example first base connection member 505 and the example second base connection member 515. In some examples, as described more fully in FIGS. 8-10, the base joint 525 includes a connection feature such as a notch to receive and retain the second end of the first resilient member 610. In some examples, the base joint 525 includes a clip, a locking member, or an adhesive to receive and retain the second end of the first resilient member 610. In other examples, a first resilient member connects one of the plurality of notches to the first base connection member 505 and a second resilient member connects the same one of the plurality of notches to the second base connection member 515.

In the deployed or uncompressed state of FIG. 6, the example first base connection member 505 and the example second base connection member 515 are each rotated about the respective lines of weakness 510, 520 to a position that is acute to the first substrate 102 and the second substrate 104. In other words, the example first base connection member 505 and the example second base connection member 515 are maintained in an at least partially folded state in deployment, which is to facilitate closure of the example polyhedral display 100. However, in some examples, one of the plurality of notches 600 includes a notch at or near a height of the lines of weakness 510, 520, so as to bias the example first base connection member 505 and the example second base connection member 515 into at least a substantially flat position (e.g., parallel or co-planar) relative to one another.

Figure 7:
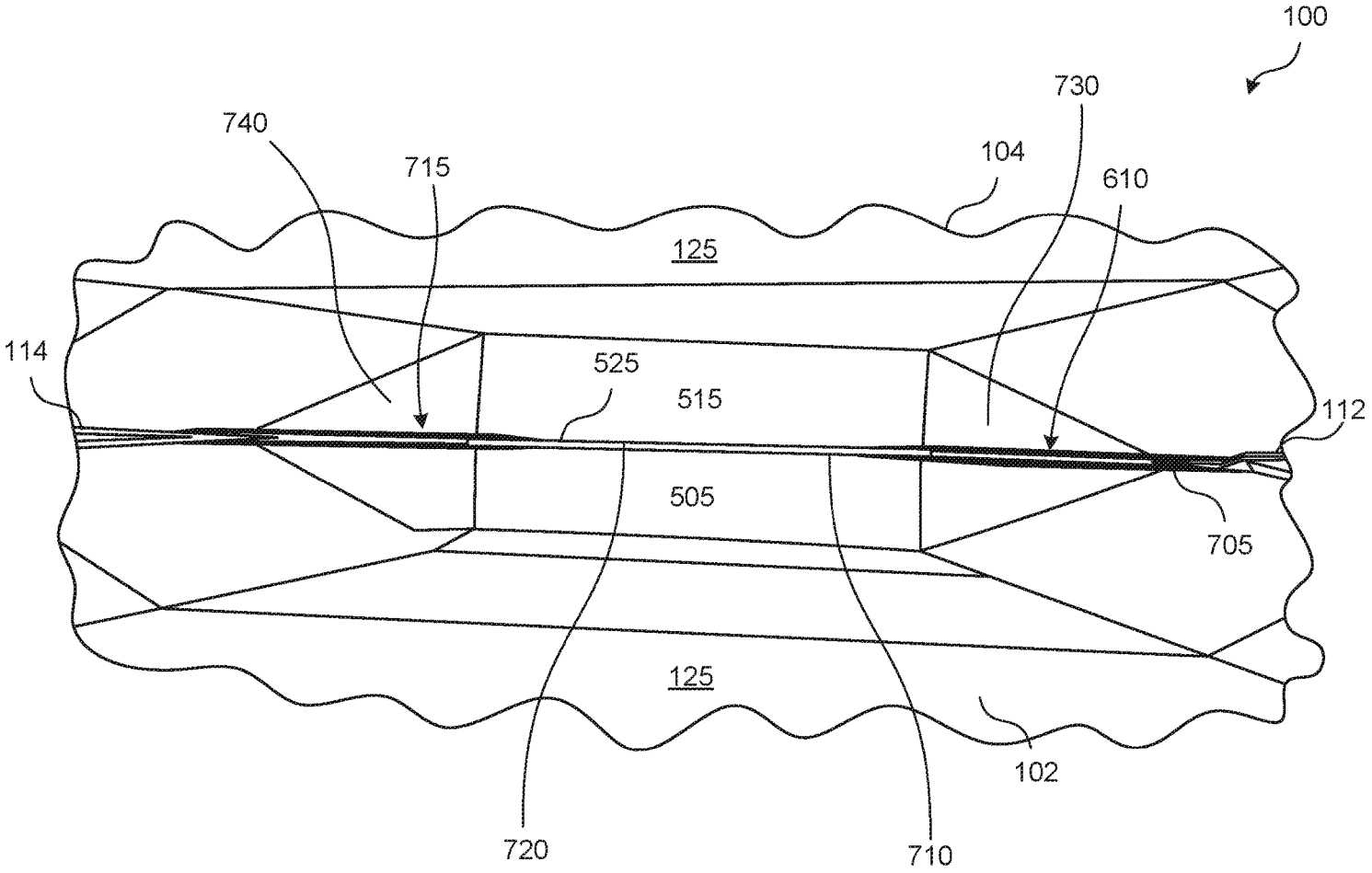
FIG. 7 is a top down view of an interior of the example polyhedral display of FIG. 5.

FIG. 7 is top down view of an interior of the example polyhedral display 100 of FIG. 5, from a perspective of the second segment 125. From this vantage, it can be observed that a first resilient member 610 connects the first lateral joint 112 to a first connection point 710 on or adjacent the base joint 525 and a second resilient member 715 connects the second lateral joint 114 to a second connection point 720 on or adjacent the base joint 525. In some examples, a plurality of different connections points are provided along the base joint 525 and/or along the first lateral joint 112 and the second lateral joint 114 to permit positioning of the example first base connection member 505, the example second base connection member 515 and the base joint 525 at one of a plurality of predetermined positions.

In some examples, rather than attaching the first resilient member 610 to the first connection point 710 on or adjacent the base joint 525 and a second resilient member 715 to a second connection point 720 on or adjacent the base joint 525, a resilient member is connected, at a first end, to a first connection element (e.g., a notch, etc.) on the first lateral joint 112 and a second end of the resilient member is routed through the example opening 730, below the base joint 525, through the example opening 740 and is connected to a second connection element (e.g., a notch, etc.) on the second lateral joint 114.

Figure 8:
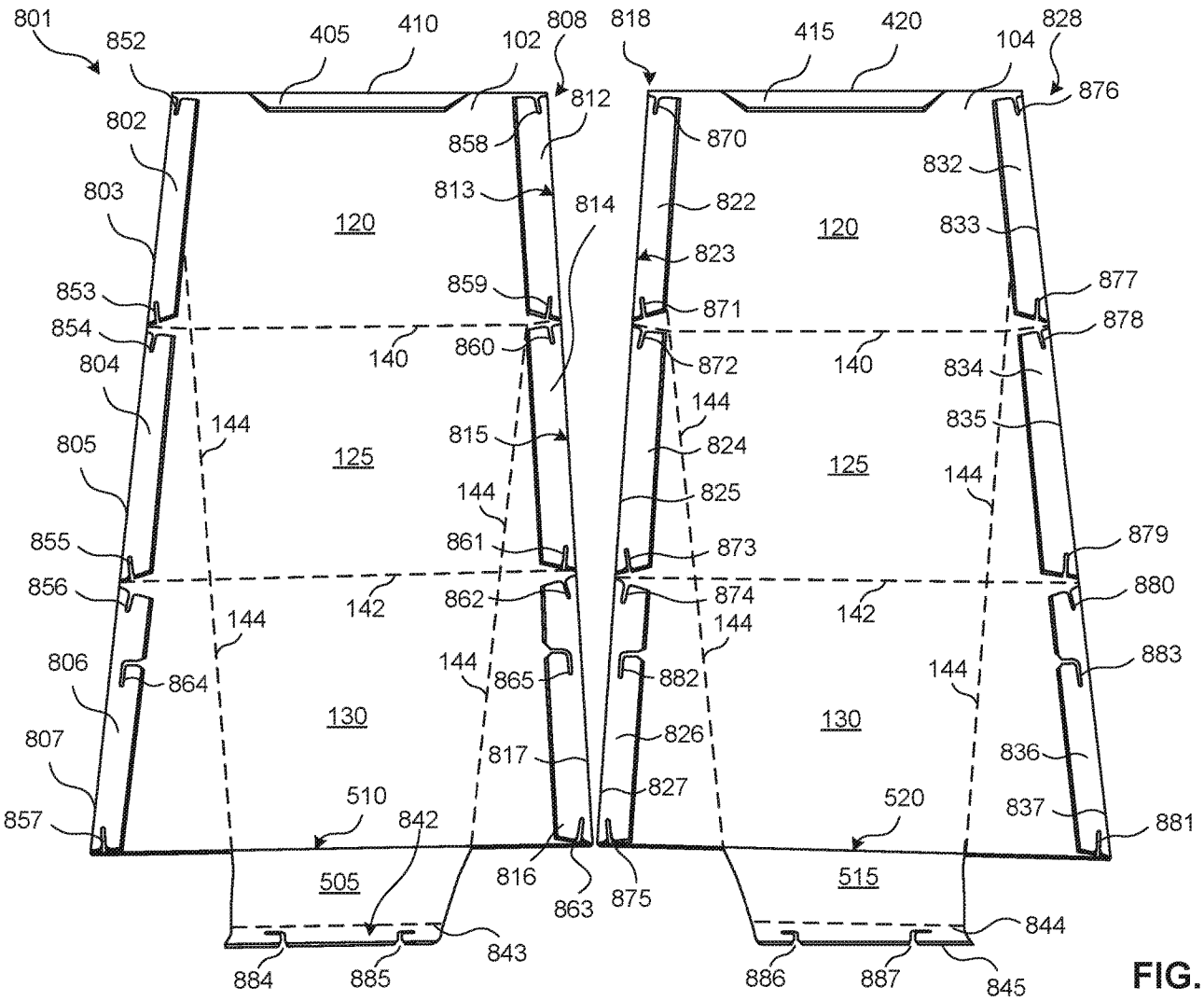
FIG. 8 is a perspective view of a first substrate and a second substrate used to form the example polyhedral display of FIGS. 1-7 in accordance with teachings herein.

FIG. 8 illustrates an example intermediary stage of assembly of the example polyhedral display 100 of FIGS. 2-3. An example method of assembly includes, as shown in FIG. 8, disposing the first substrate 102 adjacent to the second substrate 104 along a length of the first substrate 102 and the second substrate 104. In FIG. 8, the adjacent sides of the first substrate 102 and the second substrate 104 form, in the assembled stated, the second lateral joint 114.

The example first substrate 102 and the example second substrate 104 each include a first segment 120, a second segment 125 and a third segment 130. The example first substrate 102 includes, at a first lateral side 801, a first connection member 802 hinged to the example first substrate 102 by a line of weakness 803, a second connection member 804 hinged to the example first substrate 102 by a line of weakness 805, and a third connection member 806 hinged to the example first substrate 102 by a line of weakness 807. The example first substrate 102 includes, at a second lateral side 808, a first connection member 812 hinged to the example first substrate 102 by a line of weakness 813, a second connection member 814 hinged to the example first substrate 102 by a line of weakness 815, and a third connection member 816 hinged to the example first substrate 102 by a line of weakness 817.

The example second substrate 104 includes, at a first lateral side 818, a first connection member 822 hinged to the example second substrate 104 by a line of weakness 823, a second connection member 824 hinged to the example second substrate 104 by a line of weakness 825, and a third connection member 826 hinged to the example second substrate 104 by a line of weakness 827. The example second substrate 104 includes, at a second lateral side 828, a first connection member 832 hinged to the example second substrate 104 by a line of weakness 833, a second connection member 834 hinged to the example second substrate 104 by a line of weakness 835, and a third connection member 836 hinged to the example second substrate 104 by a line of weakness 837.

The example first base connection member 505 depends from the example first substrate 102 and is hinged to the example first substrate 102 by the line of weakness 510 at a proximal end of the first base connection member 505. The first base connection member 505 includes, at a distal end, a connection member 842 connected to the first base connection member 505 by a line of weakness 843. The example second base connection member 515 depends from the example second substrate 104 and is hinged to the example second substrate 104 by the line of weakness 520 at a proximal end of the second base connection member 515. The second base connection member 515 includes, at a distal end, a connection member 845 connected to the second base connection member 515 by a line of weakness 844.

FIG. 8 also shows, in greater detail, the plurality of notches 600 noted above in relation to FIG. 6. The plurality of notches 600 includes, at the first lateral side 801 of the example first substrate 102, example notches 852, 853 in first connection member 802, example notches 854, 855 in the second connection member 804, and example notches 856,857 in the third connection member 806. The plurality of notches 600 includes, at the second lateral side 808 of the example first substrate 102, example notches 858, 859 in the first connection member 812, example notches 860, 861 in the second connection member 814, and example notches 862, 863 in the third connection member 816. The third connection member 806 also includes an example notch 864 and the third connection member 816 also includes an example notch 865. The plurality of notches 600 includes, at the first lateral side 818 of the example second substrate 104, example notches 870, 871 in the first connection member 822, example notches 872, 873 in the second connection member 824, and example notches 874, 875 in the third connection member 826. The plurality of notches 600 includes, at the second lateral side 828 of the example second substrate 104, example notches 876, 877 in the first connection member 832, example notches 878, 879 in the second connection member 834, and example notches 880, 881 in the third connection member 836. The third connection member 826 also includes an example notch 882. The third connection member 836 also includes an example notch 883.

Figure 9:
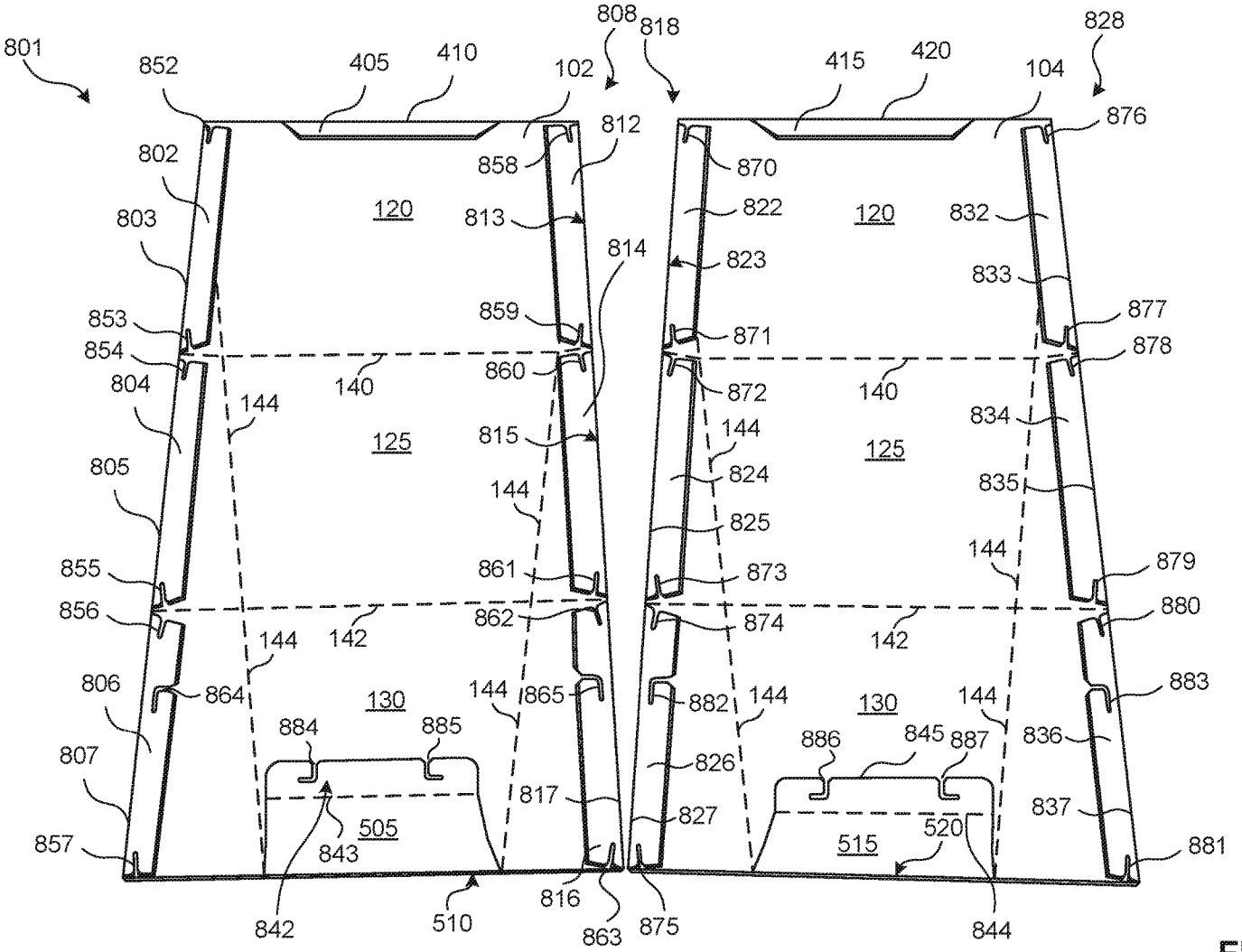
FIG. 9 is a perspective view of the first substrate and the second substrate of FIG. 8 with base connection members in a position for assembly in accordance with teachings herein.

FIG. 9 shows the example first substrate 102 and the example second substrate 104 in a second stage of assembly of the example polyhedral display 100 of FIGS. 2-3 where the example first base connection member 505 is folded about the line of weakness 510 and the example second base connection member 515 is folded about the line of weakness 520.

In some examples, a height of the connection member 842 and the connection member 845 may be selectively varied to adjust a height differential between the example notches 865, 882, the example notches 864, 883, and the corresponding notches 884, 885, 886, 887 of the connection members 842, 845. As the position of the notches 884, 885, 886, 887 changes relative to the notches 864, 865, 882, 883, the tension applied to the resilient member(s) (e.g., 610, 715) secured therebetween may be increased or decreased. In some examples, the connection members 842, 845 may include not only a plurality of selectable notches to which ends of resilient members may be attached, but may also include a plurality of selectable notches at a plurality of different heights. For example, in the configuration depicted in FIG. 10, the connection members 842, 845 may extent to a greater height (e.g., vertical position) that that depicted, with notches being formed at different vertical positions of the connection members 842, 845.

Figure 10:
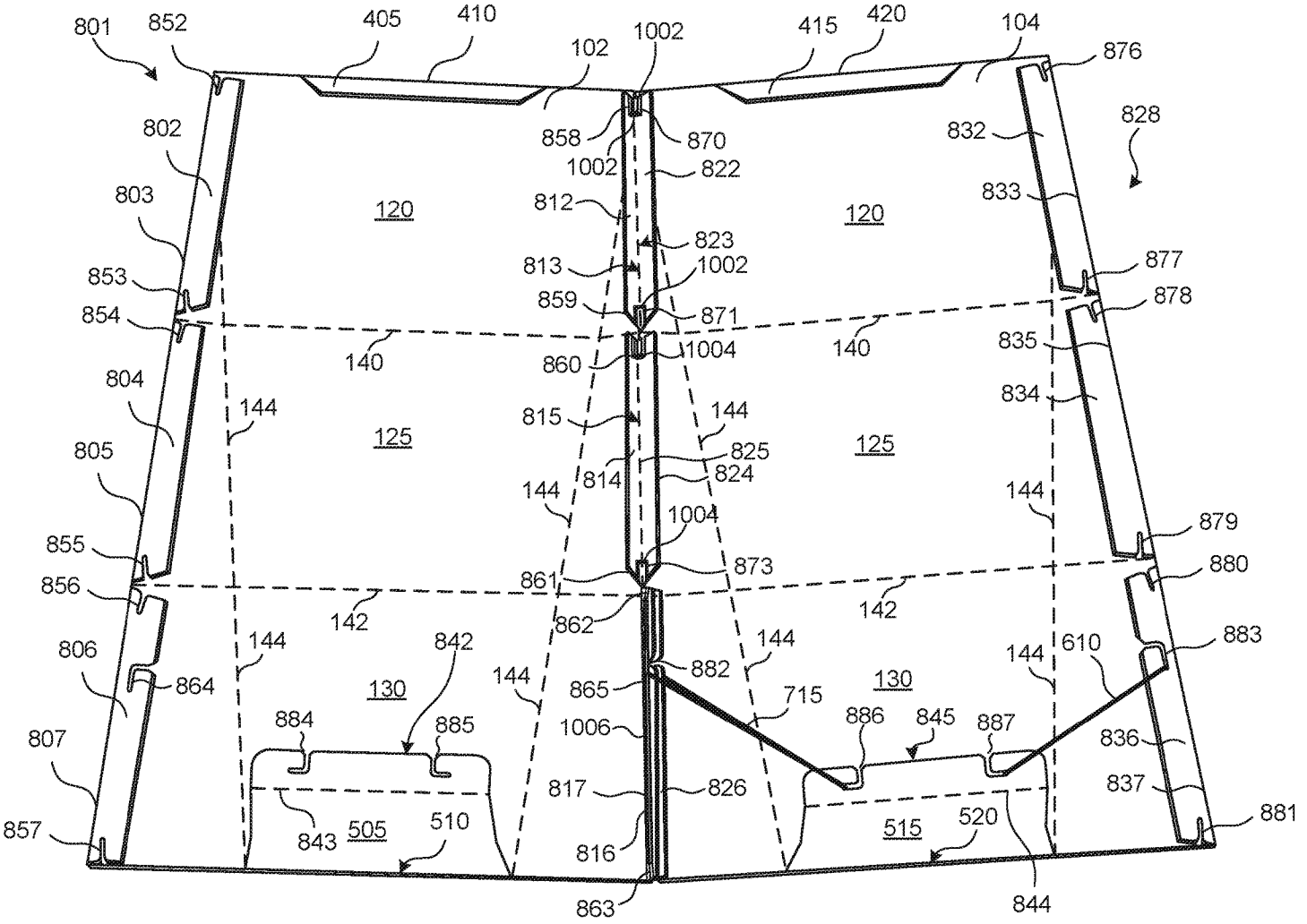
FIG. 10 is a perspective view of the first substrate and the second substrate of FIGS. 8-9 connected along a first lateral joint showing a stage of assembly in accordance with teachings herein.

FIG. 10 shows the example first substrate 102 and the example second substrate 104 in a third stage of assembly of the example polyhedral display 100 of FIGS. 2-3 where the example second lateral side 808 of the first substrate 102 is attached to the first lateral side 818 of the second substrate 104. In the example of FIG. 10, the second connection member 812 of the first substrate 102 is connected to the first connection member 822 of the second substrate 104, the second connection member 814 of the first substrate 102 is connected to the second connection member 824 of the second substrate 104 and the third connection member 816 of the first substrate 102 is connected to the third connection member 826 of the second substrate 104. In the example of FIG. 10, the first connection member 812 and the first connection member 822 are connected by a resilient member 1002 engaging the notches 858, 870 at a first end and the notches 859, 871 at a second end. The second connection member 814 and the second connection member 824 are connected by a resilient member 1004 engaging notches 860, 872 at a first end and notches 861, 873 at a second end. The third connection member 816 and the third connection member 826 are connected by a resilient member 1006 engaging the notches 862, 874 at a first end and the notches 863, 875 at a second end.

In the example stage of assembly shown in FIG. 10, a second resilient member 715 having a first end connected to the notches 865, 882 of the second lateral joint 114 and a second end connected to the notch 886 of the connection member 845. Also shown in FIG. 10 is the resilient member 610 with a first end connected to the notch 883 of the connection member 836 and with a second end connected to the notch 887 of the connection member 842. In some examples, following the stage of assembly shown in FIG. 10, the first substrate 102 is folded about the second lateral axis 114 to place the first connection member 802, the second connection member 804, and the third connection member 806 of the first substrate 102 in opposition to and adjacent the first connection member 832, the second connection member 834 and the third connection member 836, respectively, of the second substrate 104. In this position, with the first substrate 102 being folded over the second substrate 104, the first end of the first resilient member 610 is positioned about the notch 864 in the first connection member 806 of the first substrate 102 and the second end of the first resilient member 610 is positioned about the notch 883 of the connection member 845.

In some examples, a third resilient member is provided with a first end connecting notches other than notches 865, 882 (e.g., notches 863, 875) of the second lateral joint 114 and a second end connected to the notch 886 of the connection members 842, 845, or to another notch formed on the connection members 842, 845 and a fourth resilient member is provided with a first end connecting notches other than notches 864, 884 (e.g., notches 857, 881) of the first lateral joint 112 and a second end connected to the notch 887 of the connection members 842, 845, or to another notch formed on the connection members 842, 845. In some examples, the second resilient member 715 is provided with a first end connecting notches 863, 875 of the second lateral joint 114 and a second end connected to the notch 886 of the connection members 842, 845 and the first resilient member 610 is provided with a first end connecting notches 857, 881 of the first lateral joint 112 and a second end connected to the notch 887.

In the example of FIG. 10, additional resilient members are used to connect the first connection member 802, the second connection member 804, and the third connection member 806 of the first lateral side 801 of the first substrate 102 to the corresponding first connection member 832, the second connection member 834 and the third connection member 836 of the second lateral side 828 of the second substrate 104. In the example of FIG. 10, the first connection member 802 and the first connection member 832 are connected by a resilient member engaging the notches 852, 876 at a first end and the notches 853, 877 at a second end. The second connection member 804 and the second connection member 834 are connected by a resilient member engaging notches 854, 878 at a first end and notches 855, 879 at a second end. The third connection member 806 and the third connection member 836 are connected by a resilient member engaging the notches 856, 880 at a first end and the notches 857, 881 at a second end.

In some examples, the example method may further include disposing an adhesive between first upper connection member 405 and second upper connection member 415 and bonding together the first upper connection member 405 and the second upper connection member 415.

In some examples, the example method may further include disposing an adhesive between the connection member 842 of the example first base connection member 505 and the connection member 845 of the example second base connection member 515 and bonding together the connection member 842 and the connection member 845.

In some examples, the polyhedral display 100 is formed from a single substrate having a line of weakness in lieu of the second lateral joint 114. With reference to the example of FIG. 10 having three segments 120, 125, 130, such single substrate would include, a first lateral side (e.g., 801), the connection members 802, 804, 806 and, at a second lateral side (e.g., 828), the connection members 832, 834, 836. Because the connection members 816, 826 are omitted in this single substrate example, so too are the example notches 865, 882 formed therein. In some examples, securement of the resilient member 715 in this single substrate polyhedral display 100 is achieved by an adhesive. In some examples, securement of the resilient member 715 in this single substrate polyhedral display 100 is achieved by an adhesively attached mechanical connection member or a cutout (e.g., a downwardly directed or upside-down U-shaped cutout along the line of weakness corresponding in location to the second joint 114) to which the resilient member 715 is secured. While an example single substrate polyhedral display 100 having three segments has been described, such single substrate polyhedral display 100 may comprise any number of segments (e.g., one segment, two segments, three segments, four segments, etc.).

The method of forming the polyhedral display 100 further includes, in some examples, the act of stowing the assembled example polyhedral display 100 by flattening each segment 120, 125, 130 to extend the second resilient member 715 and the first resilient member 610 (see FIG. 10) and by rotating each segment 120, 125, 130 about the respective lines of weakness 140, 142 while maintaining tension on the second resilient member 715 and the first resilient member 610.

Figure 11:
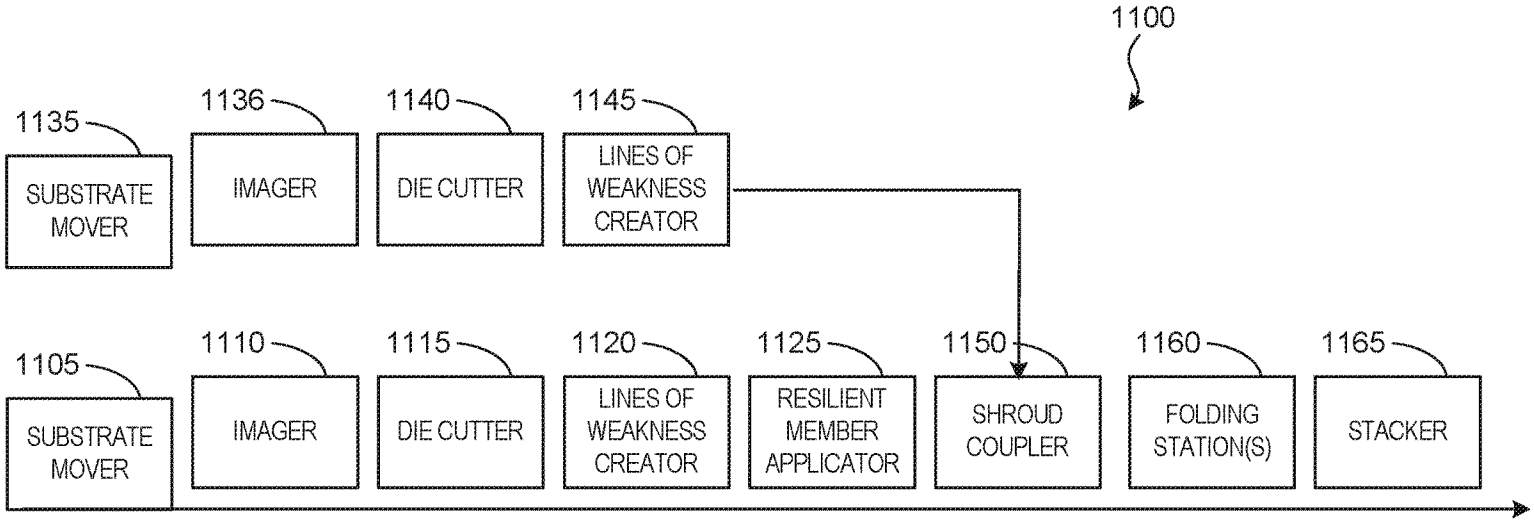
FIG. 11 is a block diagram of an example apparatus that can be used to produce the example polyhedral display of FIGS. 2-3.

FIG. 11 represents an example apparatus 1100 that can be used to produce the example polyhedral display 100 of FIGS. 2-3. In some examples, the apparatus 1100 performs an in-line process that includes processes to produce the example shroud 105 in accordance with the teachings of this disclosure, example processes to produce the example polyhedral display 100 in accordance with the teachings herein. While the processes disclosed below are described in connection with automatic processes, any and/or all of the processes disclosed may instead be implemented manually.

In the illustrated example, the example apparatus 1100 includes elements to produce the example shroud 105 and/or the example polyhedral display 100, including, for example, a substrate mover 1105, an imager 1110, a die cutter 1115, a lines of weakness creator 1120, a resilient member applicator 1125, a substrate mover 1135, an imager 1136, a die cutter 1140, a lines of weakness creator 1145, a shroud coupler 1150, a folding station 1060, and a stacker 1165.

To produce the example shroud 105 in accordance with the teachings of this disclosure, in some examples, the substrate mover 1105 feeds a first substrate (e.g., the first substrate 102, etc.) and/or a web of substrate material (e.g., cardboard, paperboard, card stock, plastic material(s), and combination(s) of material(s), etc.) into the apparatus 1100.

In some examples, the imager 1110 images an outer surface of the first substrate and/or web of substrate conveyed by the substrate mover 1105 (e.g., imaging an outer surface of the first substrate 102). The images may include brand-related images and/or text, advertising-related images and/or text, point-of-purchase-related images and/or text, instructional images and/or text, and/or any other desired indicia.

The die cutter 1115 forms a substrate, if a web of substrate (e.g., continuous stock, etc.) is conveyed by the substrate mover 1105, and forms one or more features and/or notches within the substrate including, for example, grooves and/or notches (e.g., 852, 853, 854, 855, 856, 857, 864, 884, 885, etc.) on connection members (e.g., 802, 804, 806, 842, etc.) of the substrate (e.g., first substrate 102).

The lines of weakness creator 1120 forms one or more lines of weakness on the first and/or second side of the substrate (e.g., first substrate 102) using one or more die(s), one or more cutting tool(s), one or more scoring tool(s), or one or more slotting tool(s). For example, the lines of weakness creator 1120 may form the lines of weakness 140, 142, 144, 843 (see, e.g., FIG. 8) in one or more actions.

The example resilient member applicator 1125 couples one or more elastic bands (e.g., 1002, 1004, 1006, 715, 610, etc.) to, or adjacent to, one or more connection members (e.g., 812, 814, 816, 842) of the substrate (e.g., first substrate 102).

In some examples, as shown in FIG. 11, the substrate mover 1135 feeds a second substrate (e.g., the second substrate 104, etc.) and/or a web of substrate material (e.g., cardboard, paperboard, card stock, etc.) into the apparatus 1100.

In some examples, the imager 1136 images an outer surface of the second substrate and/or web of substrate conveyed by the substrate mover 1135 (e.g., imaging an outer surface of the second substrate 104). The images may include brand-related images and/or text, advertising-related images and/or text, point-of-purchase-related images and/or text, instructional images and/or text, and/or any other desired indicia.

The die cutter 1140 forms a substrate, if a web of substrate (e.g., continuous stock, etc.) is conveyed by the substrate mover 1135, and forms one or more features and/or notches within the substrate including, for example, grooves and/or notches (e.g., 870, 871, 872, 873, 874, 875, 882, 886, 887, etc.) on connection members (e.g., 822, 824, 826, 845, etc.) of the substrate (e.g., second substrate 104).

The lines of weakness creator 1145 forms one or more lines of weakness on the first and/or second side of the substrate (e.g., second substrate 104) using one or more die(s), one or more cutting tool(s), one or more scoring tool(s), or one or more slotting tool(s). For example, the lines of weakness creator 1145 may form the lines of weakness 140, 142, 144, 844 (see, e.g., FIG. 8) in one or more actions.

In some examples, the shroud coupler 1150 forms the polyhedral display 100 shroud by folding the connection members 802, 804, 806, 812, 814, 816, 845 of the first substrate 102 about their respective lines of weakness 803, 804, 805, 813, 815, 817, 843 and folding the connection members 822, 824, 826, 832, 834, 836, 845 of the second substrate 104 about their respective lines of weakness 823, 825, 827, 833, 835, 837, 844 and by coupling respective pairs of inwardly facing and opposing connection members (e.g., 802, 832) via grooves (e.g., 852, 853, 876, 877) using the resilient members (e.g., rubber bands, etc.) provided by the resilient member applicator 1125.

The folding station 1160 flattens and/or folds the polyhedral display 100 along the longitudinal axes of the shroud 105 and/or folds the polyhedral display about the transverse axes of the shroud, along the line(s) of weakness 140, 142, for storage and/or shipping. The stacker 1165 stacks the polyhedral displays 100 for storage and/or shipping. In some examples, one or more of the processes implemented by the resilient member applicator 1125, the shroud coupler 1150, the folding station 1160 and/or the stacker 1165 in FIG. 11 are performed manually.

While the stations and/or portions, including the example substrate mover 1105, the example imager 1110, the example die cutter 1115, the example lines of weakness creator 1120, the example resilient member applicator 1125, the example substrate mover 1135, the example imager 1136, the example die cutter 1140, the example lines of weakness creator 1145, the example shroud coupler 1150, the example folding station 1060, and the example stacker 1165 are depicted in a particular order, the stations and/or portions, including the example substrate mover 1105, the example imager 1110, the example die cutter 1115, the example lines of weakness creator 1120, the example resilient member applicator 1125, the example substrate mover 1135, the example imager 1136, the example die cutter 1140, the example lines of weakness creator 1145, the example shroud coupler 1150, the example folding station 1060, and the example stacker 1165 may be implemented in any other way.

For example, the order of the stations and/or portions including the example substrate mover 1105, the example imager 1110, the example die cutter 1115, the example lines of weakness creator 1120, the example resilient member applicator 1125, the example substrate mover 1135, the example imager 1136, the example die cutter 1140, the example lines of weakness creator 1145, the example shroud coupler 1150, the example folding station 1060, and/or the example stacker 1165 may be changed, and/or some of the example substrate mover 1105, the example imager 1110, the example die cutter 1115, the example lines of weakness creator 1120, the example resilient member applicator 1125, the example substrate mover 1135, the example imager 1136, the example die cutter 1140, the example lines of weakness creator 1145, the example shroud coupler 1150, the example folding station 1060, and/or the example stacker 1165 may be changed, eliminated, and/or combined. For example, while the apparatus 1100 is depicted as having a die cutter 1115 separate from a lines of weakness creator 1120, in some examples, the die cutter 1115 and the lines of weakness creator 1120 may be combined. Likewise, while the apparatus 1100 is depicted as having a die cutter 1140 separate from a lines of weakness creator 1145, in some examples, the die cutter 1140 and the lines of weakness creator 1145 may be combined.

Figure 12:
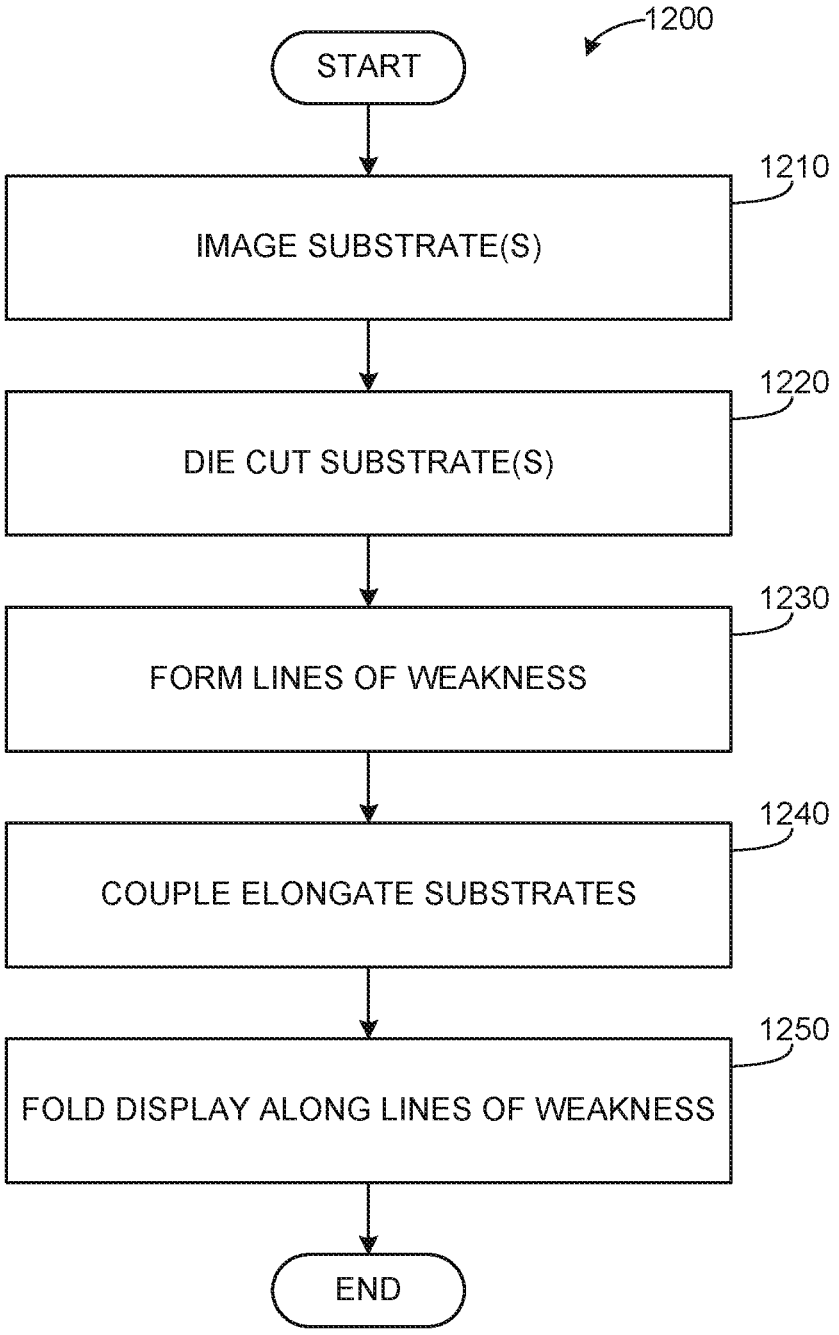
FIG. 12 illustrates a flowchart representative of machine-readable instructions that may be executed to implement the apparatus of FIG. 11 in accordance with teachings herein.

A flowchart representative of example machine-readable instructions for implementing the apparatus of FIG. 11 is shown in FIG. 12. In this example, the machine-readable instructions comprise a program for execution by a processor such as the processor 1312, shown in the example processor platform 1300 discussed below in connection with FIG. 13. The program may be embodied in software stored on a tangible computer-readable storage medium such as a CD-ROM, a floppy disk, a hard drive, a digital versatile disk (DVD), a Blu-ray disk, or a memory associated with the processor 1312, but the entire program and/or parts thereof could alternatively be executed by a device other than the processor 1312 and/or embodied in firmware or dedicated hardware. Further, although the example program is described with reference to the flowchart illustrated in FIG. 12, many other methods of implementing the example apparatus 1100 of FIG. 11 may alternatively be used. For example, the order of execution of the blocks may be changed, and/or some of the blocks described may be changed, eliminated, or combined.

As mentioned above, the example processes of FIG. 13 may be implemented using coded instructions (e.g., computer and/or machine-readable instructions) stored on a tangible computer-readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term "tangible computer-readable storage medium" is expressly defined to include any type of computer-readable storage device and/or storage disk and to exclude propagating signals and transmission media. As used herein, "tangible computer-readable storage medium" and "tangible machine-readable storage medium" are used interchangeably. Additionally or alternatively, the example processes of FIG. 13 may be implemented using coded instructions (e.g., computer and/or machine-readable instructions) stored on a non-transitory computer and/or machine-readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term "non-transitory computer-readable medium" is expressly defined to include any type of computer-readable storage device and/or storage disk and to exclude propagating signals and transmission media. As used herein, when the phrase "at least" is used as the transition term in a preamble of a claim, it is open-ended in the same manner as the term "comprising" is open-ended.

The process 1200 of FIG. 12 includes imaging one or more substrates (e.g., one substrate, the first substrate 102 and the second substrate 104, etc.) (block 1210) using, for example, the imager 1110 and/or the imager 1136 to image a first and/or second side of the first substrate 102 and/or the second substrate 104 and/or from a stock material from which the first substrate 102 and/or the second substrate 104 are to be formed. The imaging may include, for example, brand-related images and/or text, advertising-related images and/or text, point-of-purchase-related images and/or text, instructional images and/or other text, indicia and/or images.

The substrates are die cut (block 1220) using, for example, the die cutter 1115 to form the first substrate 102 and the die cutter 1140 to form the second substrate 104 and to form features in the first substrate 102 and the second substrate 104, respectively such as, but not limited to, formation of the connection members and notches therein. In some examples, a single die cutter (e.g., 1115) is used to form the first substrate 102 and the second substrate 104 and to form features in the first substrate 102 and the second substrate 104, including the connection members and notches.

In block 1230, lines of weakness 140, 142, 144, 843 (see, e.g., FIG. 8) are formed in the first substrate 102 and the second substrate 104 using, for example, the lines of weakness creator 1120 and/or the line of weakness creator 1145 via one or more die(s), one or more cutting tool(s), one or more scoring tool(s) or one or more slotting tool(s).

In block 1240, the first substrate 102 and the second substrate 104 are coupled. In some examples, the first substrate 102 and the second substrate 104 are disposed in opposition to one another so that the first lateral side 801 of the first substrate 102 is disposed opposite the second lateral side 828 of the second substrate 104 and the second lateral side 808 of the first substrate 102 is disposed opposite the first lateral side 818 of the second substrate 104. In block 1240, the resilient member applicator 1125 applies resilient members (e.g., elastic bands) to couple the adjacent and opposing connection members (e.g., 802, 832, etc.) of the substrates (e.g., 102, 104) to define the shroud 105. In some examples, at least some of the connection members of the first substrate 102 and the second substrate 104 are coupled via an adhesive or physical attachment members (e.g., staples, etc.).

In block 1250, the formed polyhedral display 100 is folded along lines of weakness (e.g., 140, 142) using, for example, the folding station 1160 that flattens and/or folds the polyhedral display 100 about transverse axes of the shroud, such as along lines of weakness 140, 142, for storage and/or shipping. The folded polyhedral displays 100 are stacked in block 1250 using, for example, the stacker 1165 that stacks polyhedral displays 100 for storage and/or shipping, etc.

Figure 13:
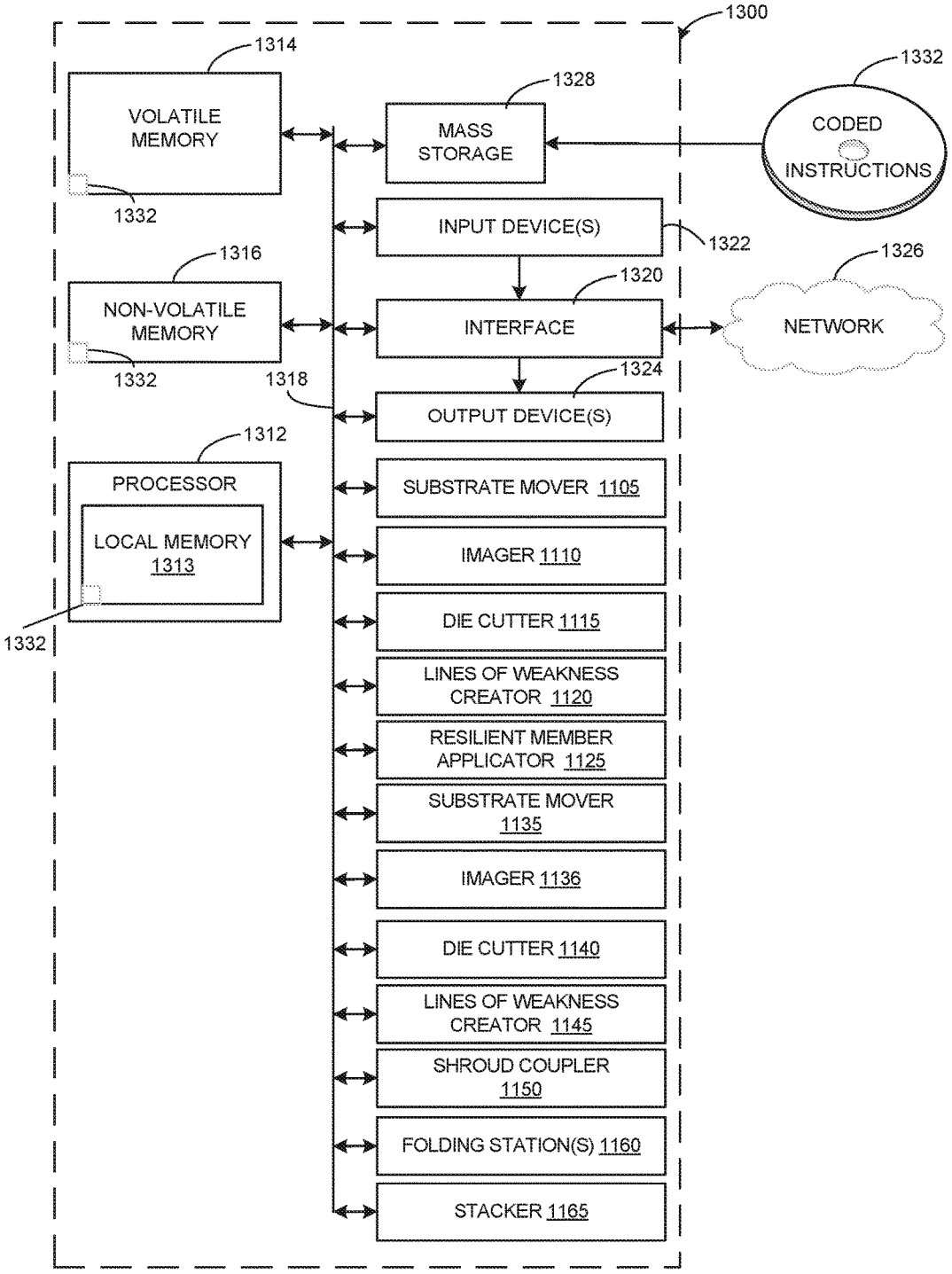
FIG. 13 illustrates a processor platform to execute the instructions of FIG. 12 to implement the apparatus of FIG. 11 in accordance with teachings herein.

FIG. 13 is a block diagram of an example processor platform 1300 capable of executing the instructions of FIG. 12 to implement the apparatus 1100 of FIG. 11 to control operation of one or more of the example substrate mover 1105, the example imager 1110, the example die cutter 1115, the example lines of weakness creator 1120, the example resilient member applicator 1125, the example substrate mover 1135, the example imager 1136, the example die cutter 1140, the example lines of weakness creator 1145, the example shroud coupler 1150, the example folding station 1060, and/or the example stacker 1165. The processor platform 1300 can be, for example, a server, a personal computer, a mobile device (e.g., a tablet such as an iPad™), an Internet appliance or any other type of computing device.

The processor platform 1300 of the illustrated example includes a processor 1312. The processor 1312 of the illustrated example is hardware. For example, the processor 1312 can be implemented by one or more integrated circuits, logic circuits, microprocessors or controllers from any desired family or manufacturer.

The processor 1312 of the illustrated example includes a local memory 1313 (e.g., a cache). The processor 1312 of the illustrated example is in communication with a main memory including a volatile memory 1314 and a non-volatile memory 1316 via a bus 1318. The volatile memory 1314 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1316 may be implemented by flash memory and/or any other desired type of memory device. Access to the main memory 1314, 1316 is controlled by a memory controller.

The processor platform 1300 of the illustrated example also includes an interface circuit 1320. The interface circuit 1320 may be implemented by any type of interface standard, such as an Ethernet interface, a universal serial bus (USB), and/or a PCI express interface.

In the illustrated example, one or more input devices 1322 are connected to the interface circuit 1320. The input device (s) 1322 permit(s) a user to enter data and commands into the processor 1312. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1324 are also connected to the interface circuit 1320 of the illustrated example. The output devices 1324 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1320 of the illustrated example, thus, typically includes a graphics driver card, a graphics driver chip or a graphics driver processor.

The interface circuit 1320 of the illustrated example also includes a communication device such as a transmitter, a receiver, a transceiver, a modem and/or network interface card to facilitate exchange of data with external machines (e.g., computing devices of any kind) via a network 1326 (e.g., an Ethernet connection, a digital subscriber line (DSL), a telephone line, coaxial cable, a cellular telephone system, etc.).

The processor platform 1300 of the illustrated example also includes one or more mass storage devices 1328 for storing software and/or data. Examples of such mass storage devices 1328 include floppy disk drives, hard drive disks, compact disk drives, Blu-ray disk drives, RAID systems, and digital versatile disk (DVD) drives.

The coded instructions 1332 of FIG. 13 may be stored in the mass storage device 1328, in the volatile memory 1314, in the non-volatile memory 1316, and/or on a removable tangible computer readable storage medium such as a CD or MD.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A display apparatus, comprising:

a first substrate and a second substrate disposed in opposition to one another and connected to one another to form a shroud, the first substrate and the second substrate being connected to form a first joint at a first lateral end of the shroud, a second joint at a second lateral end of the shroud and a third joint formed at a lower portion of the shroud, the third joint including a first base connection member rotatably depending from a lower portion of the first substrate and a second base connection member rotatably depending from a lower portion of the second substrate, the third joint being located at a first position in the shroud with the shroud in a compressed state and being located in a second position in the shroud with the shroud in an uncompressed state; and a resilient member connecting the first joint to the third joint and connecting the second joint to the third joint to bias the third joint from the first position to the second position when the shroud is the uncompressed state.

2. The display apparatus according to claim 1, wherein each of the first substrate and the second substrate include a plurality of segments, with adjacent segments being connected by a line of weakness permitting the adjacent segments to be folded about the line of weakness.

3. The display apparatus according to claim 2, wherein the first substrate and the second substrate are connected to form a fourth joint at an upper portion of the shroud, the fourth joint including a connecting member of the first substrate and a connecting member of the second substrate.

4. The display apparatus according to claim 1, wherein the display assumes a wedge shape in the uncompressed state.

5. The display apparatus according to claim 4, wherein the display is a polyhedral display.

6. The display apparatus according to claim 5, wherein the first substrate includes a line of weakness angled inwardly from a lateral side of a top portion of the first substrate to an inner portion of a bottom portion of the first substrate.

7. The display apparatus according to claim 6, wherein the second substrate includes a line of weakness angled inwardly from a lateral side of a top portion of the second substrate to an inner portion of a bottom portion of the second substrate.

8. The display apparatus according to claim 1, wherein the first base connection member rotatably depends from the lower portion of the first substrate by a line of weakness formed between a bottom segment of the first substrate and the first base connection member and the second base connection member rotatably depends from the lower portion of the second substrate by a line of weakness formed between a bottom segment of the second substrate and the second base connection member.

9. The display apparatus according to claim 1, wherein the first base connection member includes a first connection member connected to the first base connection member by a line of weakness and the second base connection member includes a second connection member connected to the second base connection member by a line of weakness.

10. The display apparatus according to claim 9, wherein the first base connection member and the second base connection member span a portion of a width of the first substrate and the second substrate, respectively, defining a first opening between the first base connection member, the second base connection member and the first joint and defining a second opening between the first base connection member, the second base connection member and the second joint.

11. The display apparatus according to claim 10, wherein the resilient member is passed from the connection at the first joint, through the first opening, across a bottom of the third joint formed between the first base connection member and the second base connection member, through the second opening, and to the connection at the second joint.

12. The display apparatus according to claim 1, wherein the resilient member includes a first resilient member and a second resilient member, wherein the first resilient member connects the first joint to the third joint and wherein the second resilient member connects the second joint to the third joint.

13. The display apparatus according to claim 12, wherein the first connection member of the first base connection member and the second connection member of the second base connection member include a first notch to receive the first resilient member and a second notch to receive the second resilient member.

14. The display apparatus according to claim 13, wherein the first joint and the second joint include a plurality of notches to provide a plurality of selectable attachment points for the first resilient member and the second resilient member.

15. The display apparatus according to claim 2, wherein the first joint includes a connection between a first connection member at a first lateral side of the first substrate and a corresponding first connection member at a second lateral side of the second substrate, and wherein the second joint includes a connection between a first connection member at a second lateral side of the first substrate and a corresponding first connection member at a first lateral side of the second substrate.

16. The display apparatus according to claim 15, wherein the first joint further includes a connection between a second connection member at the first lateral side of the first substrate and a corresponding second connection member at the second lateral side of the second substrate, and wherein the second joint includes a connection between a second connection member at a second lateral side of the first substrate and a corresponding second connection member at the first lateral side of the second substrate.

17. The display apparatus according to claim 16, wherein the first joint further includes a connection between a third connection member at the first lateral side of the first substrate and a corresponding third connection member at the second lateral side of the second substrate, and wherein the second joint includes a connection between a third connection member at a second lateral side of the first substrate and a corresponding third connection member at the first lateral side of the second substrate.

18. The display apparatus according to claim 12, wherein the resilient member includes a third resilient member and a fourth resilient member, wherein the third resilient member connects the first joint to the third joint and wherein the fourth resilient member connects the second joint to the third joint.

19. The display apparatus according to claim 18, wherein the first resilient member and the third resilient member connect the third joint to different positions of the first joint and wherein the second resilient member and the fourth resilient member connect the third joint to different portions of the second joint.

20. A display, comprising:

a first substrate including a first lateral connection member at a first lateral end of a first side of the first substrate, a second lateral connection member at a second lateral end of a second side of the first substrate; and a base connection member at a lower portion of the first substrate, the first substrate including a first line of weakness extending inwardly from an upper portion of the first lateral end to a position on the first side of the first side of the first substrate at the lower portion of the first substrate, the first lateral connection member and the second lateral connection member including a feature to receive a resilient member and the base connection member including a feature to receive the resilient member; and a second substrate including a first lateral connection member at a first lateral end of a first side of the second substrate, a second lateral connection member at a second lateral end of a second side of the second substrate, and a base connection member at a lower portion of the second substrate, the second substrate including a first line of weakness extending inwardly from an upper portion of the first lateral end to a position on the first side of the first side of the second substrate at the lower portion of the second substrate, the first lateral connection member and the second lateral connection member including a feature to receive a resilient member and the base connection member including a feature to receive the resilient member.

* * * * *